United States Patent [19]

Rogier et al.

[11] Patent Number: 4,711,298

[45] Date of Patent: Dec. 8, 1987

[54] HEAT EXCHANGERS MOLDED FROM REFRACTORY MATERIAL

[75] Inventors: Serge Rogier, Avignon; Jacques Guigonis, Entraigues Sorgue, both of France

[73] Assignee: Societe Europeenne des Produits Refractaires, Courbevoie, France

[21] Appl. No.: 914,571

[22] Filed: Oct. 3, 1986

Related U.S. Application Data

[63] Continuation of Ser. No. 628,911, Jul. 9, 1984, abandoned.

[30] Foreign Application Priority Data

Jul. 11, 1983 [FR] France ..... 83 11495

[51] Int. Cl.[4] ..... F28D 7/02

[52] U.S. Cl. ..... 165/165; 165/905

[58] Field of Search ..... 165/165, 166, 905

[56] References Cited

U.S. PATENT DOCUMENTS

| | | | |
|---|---|---|---|
| 2,887,303 | 5/1959 | Reys | 165/905 X |
| 2,887,304 | 5/1959 | Hilliard | 165/905 X |
| 3,153,279 | 10/1964 | Chessin | 165/905 X |
| 3,940,301 | 2/1976 | Straw et al. | 165/166 X |
| 4,026,746 | 5/1977 | Straw | 165/905 X |
| 4,041,591 | 8/1977 | Noll et al. | 165/165 X |
| 4,041,592 | 8/1977 | Kelm | 165/165 X |
| 4,156,625 | 5/1979 | Wachendorfer, Sr. | 165/164 X |
| 4,222,434 | 9/1980 | Clyde | 165/905 X |
| 4,265,302 | 5/1981 | Förster et al. | 165/165 |
| 4,298,059 | 11/1981 | Krawth et al. | 165/166 |
| 4,308,067 | 12/1981 | Guigonis et al. | 501/105 |
| 4,343,354 | 8/1982 | Weber | 165/905 X |
| 4,545,429 | 10/1985 | Place, Jr. et al. | 165/905 X |

FOREIGN PATENT DOCUMENTS

| | | |
|---|---|---|
| 2458140 | 6/1976 | Fed. Rep. of Germany . |
| 2118014 | 7/1972 | France . |
| 2429763 | 1/1980 | France . |
| 2449662 | 9/1980 | France . |
| 2458520 | 1/1981 | France . |
| 766668 | 1/1957 | United Kingdom . |

*Primary Examiner*—Albert W. Davis, Jr.
*Assistant Examiner*—Richard R. Cole
*Attorney, Agent, or Firm*—Watson, Cole, Grindle & Watson

[57] ABSTRACT

A heat exchanger for use in industries concerned with utilizing corrosive or abrasive fluids, either at low or high temperatures, is made of a monolithic body molded from refractory material and includes at least one channel for the fluid to be heated and at least one channel for the fluid to be cooled, these channels being integrally molded and in a mutual heat-exchange relationship.

12 Claims, 4 Drawing Figures

HEAT EXCHANGERS MOLDED FROM REFRACTORY MATERIAL

BACKGROUND OF THE INVENTION

This application is a continuation of application Ser. No. 628,911, filed July 9, 1984, now abandoned.

The invention relates to heat exchangers molded from refractory material.

There are a large number of industrial fields which need heat exchangers capable of working with corrosive and/or abrasive fluids at low or high temperatures, the term "low temperature" generally denoling a temperature below about 700° C. and the term "high temperature" referring to temperatures ranging from 700° C. to about 1400° C.

The following are non-limiting examples of such fields:

power stations fuelled by coal or heavy gas oil (air heaters working on fumes rich in $SO_2$ and in abrasive ash);

air heaters on sulfur boilers;

incineration furnaces producing fumes rich in $Cl_2$, HCL, $SO_2$, $H_2SO_4$ and $HNO_3$;

ore roasting furnaces producing fumes rich in $CL_2$, $SO_2$ and metal oxides;

glass furnaces producing aggressive fumes;

metallurgy furnaces (pusher furnaces, Pitts furnaces) producing fumes rich in iron oxide;

brick kilns and cement kilns producing fumes rich in abrasive ash; and condensers of aggressive vapors on synthesis reactors.

SUMMARY OF THE INVENTION

The object of the present invention is to provide new monolithic heat exchangers produced by molding a refractory composition, the heat exchangers having the advantage of being able to operate under much more drastic conditions than the metal or ceramic heat exchangers currently used while at the same time being considerably more economical than the latter, both from the point of view of their manufacture and from the point of view of their maintenance.

More particularly, the invention relates to a heat exchanger with separate fluids which has a body comprising at least one channel for the fluid to be heated and at least one channel for the fluid to be cooled, in a mutual heat-exchange relationship, this body being molded by casting of a refractory material setting an ambient temperature and exhibiting a shrinkage lower than 0.5%, at least one of the channels having at least one bend, and the body being completely monolithic.

The invention is particularly suitable for the manufacture of large exchangers having a body weighing more than 500 kg.

The exchanger can be molded using any refractory composition having a low shrinkage (less than 0.5%) and a good pourability and giving, after solidification or ceramization, a refractory material having good properties of resistance to abrasion and to chemical agents and also a low permeability, that is to say a permeability of less than 5 nanoperms.

Among these refractory compositions, the refractory material according to a preferred embodiment has the following composition in % by weight:

(i) 55–99% of particles of a molten and cast refractory material containing a vitreous phase, this material consisting mainly of the oxides zirconia-silicia, zirconia-silica-alumina or zirconia-silica-alumina-chromium oxide, these particles having the following size distribution: 15–45% of grains with a size of 2 to 5 mm, 20–40% of small grains with a size of 0.5 to 2 mm, 15–30% of dust with a size of 40 micrometers to 0.5 mm and 0–40% of fines with a size of less than 40 micrometers;

(ii) 1 to 5% of a hydraulic cement; and (iii) 1–15% of a filler consisting of approximately spherical particles of a metal oxide with a size of 0.01 to 5 micrometers, the specific surface area of these particles being greater than 5 $m^2/g$, the proportion of each of the constituents (i), (ii) and (iii) being given relative to the total of the ingredients (i), (ii) and (iii).

The abovementioned refractory material is described in detail in French Pat. No. 2,458,520 (U.S. Pat. No.4,308,067) of the Applicant Company. Preferably, the constituent (ii) is a superaluminous cement and the constituent (iii) consists of vitreous silica.

This refractory material possesses the characteristic of having a very low shrinkage (less than 0.1%) on solidification. This property makes it possible to obtain complex structures with great geometrical precision and to introduce networks of hollow channels made of organic material into the bulk without the appearance between these networks of cracks which would bring the channels for fluid to be heated into communication with the channels for fluid to be cooled.

This refractory material has a low permeability to gases and liquids, even under pressure, which is less than 1 nanoperm and generally of the order of 0.3 nanoperm.

The preferred refractory material used to manufacture the heat exchangers of the invention is used like a concrete by mixing it intimately, before use, with a quantity of water of between 3 and 25% and preferably of between 4 and 10% by weight, and with 0.01 to 1% of a surface-active dispersant, relative to the total weight of the ingredients (i) to (iii).

Other moldable refractory materials, including refractory concretes, could also be used, however, and the invention is in no way limited to the use of the type of refractory material specifically described above.

In a particular embodiment, the body of the heat exchanger contains a first network of channels for the fluid to be heated and a second network of channels for the fluid to be cooled, the channels of these networks being in a mutual heat-exchange relationship.

The expression "mutual heat-exchange relationship" is understood as meaning that the channels of both networks are distributed throughout the body in such a way that a channel of the first network is adjacent to at least one channel of the second network.

The networks of channels can be parallel, crossed or oblique, as desired. The present invention is very suitable for the formation of complex channel networks.

In a preferred embodiment, the channels of the first network and those of the second network emerge on different faces of the body of the exchanger.

In another particular embodiment, the refractory material also comprises short reinforcing fibers, preferably made of stainless steel. By way of illustration, it is possible to incorporate 0.5 to 3% by weight, preferably about 1.5% by weight, of such fibers into the refractory composition. These fibers enhance the mechanical properties of the body and improve the resistance of the refractory material to temperature variations.

The invention also relates to a process for the manufacture of an exchanger according to the invention, which comprises the following steps:

(a) the arrangement, in shuttering or a mold having the shape desired for the body of the exchanger, of a plurality of inserts positioned and held at the points corresponding to the desired locations of the channels in the body, the said inserts consisting of tubes and/or hollow profiles made of rigid plastic;

(b) the casting, into the shuttering or mold, of the refractory material to which mixing water has been added, with the application of means for compacting the cast composition;

(c) the drying of the molded body, followed by the passage, through the said tubes and/or hollow profiles, of a gas at a sufficiently high temperature to cause the removal of the said plastic tubes and/or profiles embedded in the dried body; and (d) if appropriate, the ceramization of the body by heating to an appropriate high temperature.

To keep the inserts in place, it is possible to fix the ends of these inserts projecting from the shuttering or mold through correspondingly shaped holes provided in the walls of the said shuttering or mold, and/or to keep them in place by a set of screens, made in particular of stainless steel wires, joined to the shuttering and having a mesh size corresponding to the diameter of the tube. In the latter case, the various steel wire screens used remain in the bulk of the refractory.

It is preferred to use tubes or profiles made of polyvinyl chloride (abbreviated to PVC). Such tubes or profiles, as well as sleeves and bends making it possible to form any desired curvatures, are readily available commercially. After stoving, these tubes or profiles leave a perfectly smooth impression.

Vibrations can be used as means for compacting the cast composition. This can be achieved, for example, by sending low-frequency compressed air through a few suitably chosen tubes or profiles or by using a vibrating table or suitable vibrators of the pneumatic or electric vibrator type or vibrating needle type.

Once ceramization has been effected and the body cooled, the latter can be lagged and, if appropriate, protected by a jacket.

The exchangers of the invention have numerous advantages compared with the conventional devices, such as a high resistance to aggressive chemical agents like chlorine, sulfur trioxide, strong acids, strong bases, metal silicates and oxides, and the like. Their high degree of hardness also gives them an excellent resistance to erosion by gases circulating at high speed and charged with abrasive ash. This high degree of hardness makes it possible to circulate fluids at high speeds which are at least twice as great as those acceptable in conventional steel-tube exchangers, which ensures a good coefficient of heat exchange between the fluids and the walls of the body and advantageously compensates for the lower thermal conductivity of the ceramic compared with the metal, with the result that the exchange areas to be provided are the same or smaller for the same heat-exchange capacity.

It should also be noted that the possibility of operating with fluids circulating at high speed assists the self-cleaning of the channels, which avoids the need to use an expensive sweeping installation.

The high heat resistance of the refractory material and the large thermal inertia of the body make it possible to use the exchangers of the invention at gas temperatures of as much as 1500° C. under variable conditions, without the risk of cracking under the action of the thermomechanical stresses.

Finally, the production cost of an exchanger according to the invention is much lower (up to 4 times lower) than that of a conventional exchanger, mainly because of the simplicity of its production, which requires fewer hours of labor.

If desired, the exchanger can be manufactured at the actual site of use. It is also possible to vary the composition of the refractory material during the casting operation so that the body has regions with different compositions best suited to the working conditions to which they will be exposed in use.

The description which now follows, which refers to the attached drawings, will provide a clear understanding of the invention.

EXAMPLE 1

This example illustrates the production of a monolithic exchanger body with separate fluids, according to the invention, having dimensions of 1 m×1 m×1 m.

Figure 1:
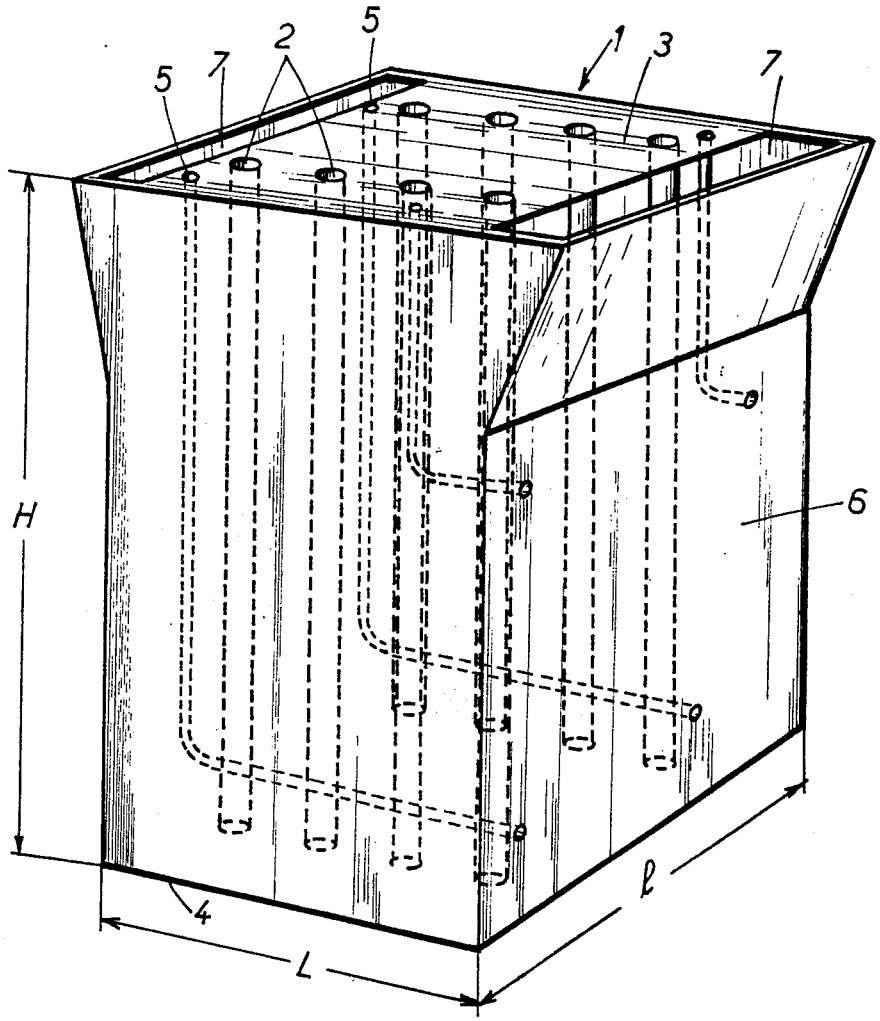
FIG. 1 is a diagrammatic view in perspective illustrating the manufacture of a heat exchanger body according to the invention.

Firstly, a network of 36 rectilinear PVC tubes 2 of diameter 6 cm, through which hot fumes, for example, are intended to flow, is arranged in a wooden mold 1 which can be taken apart and has internal dimensions of L=1 meter, l=1 meter and H=1.2 m (FIG. 1). These tubes are kept in place by the perforated plate 3 located on top of the mold and the perforated plate 4 forming the bottom of the mold. Secondly, a network of 49 PVC tubes 5 with 90° bends and of diameter 2.5 cm, through which air to be heated, for example, is intended to flow, is arranged in the mold. The tubes 5 are held in place by the perforated plate 3 and by the perforated side plate 6. In order to simplify the drawing, only 8 tubes 2 and 4 tubes 5 have been shown in FIG. 1.

The upper part of the mold is widened and two passages 7 have been made therein, through which the refractory material will be poured into the mold.

The assembly comprising the mold and the networks of PVC tubes is placed on a vibrating table (not shown) and the refractory composition of the type described in French Pat. No. 2,458,520 and marketed by the Applicant Company under the registered trademark ERSOL ® is poured into the mold through the passages 7 while at the same time causing the table to vibrate. This refractory material comprises, by weight, 91 parts of molten and cast grains of a refractory material composed of 50.6% of $Al_2O_3$, 32.5% of $ZrO_2$, 15.7% of $SiO_2$, 1.1% of $Na_2O$, 0.1% of $Fe_2O_3$ and 0.1% of $TiO_2$ (product No. 1 in Table 1 of French Pat. No. 2,458,520 (U.S. Pat. No.4,308,067) mentioned above).

The casting is stopped when the level of material comes to a few centimeters above the desired level (1 meter in the example) and vibration is continued until the densification of the product has taken place. The product is released from the mold after hardening. The body is then subjected to a heat treatment comprising a drying step at a temperature within the range of 100°-150° C., a stoving step serving to remove the PVC tubes (in general by gradual heating up to about 400° C.) and, finally, a ceramization step at high temperature (in general within the range of about 800°-1200° C.). Lastly, the body is left to cool to ambient temperature.

The same molding operation is repeated with a refractory material which is similar except that 1.5 parts by weight of stainless steel fibers of registered trademark DRAMIX ZP, 30/40 grade, sold by the Belgian company BEKAERT, are incorporated therein. These fibers are in the form of U-clips of diameter 0.3 mm and length 40 mm. They exist in AISI 302 steel for applications at temperatures not exceeding 1000° C., or in AISI 314 steel for applications at temperatrues above 1000° C. Also, 4.7 parts of water are used instead of 4.5 parts.

After baking at about 1000° C., the bodies obtained are compact whether or not steel fibers are present.

EXAMPLE 2

This example illustrates the production of a heat exchanger body with cross flows.

Figure 3:
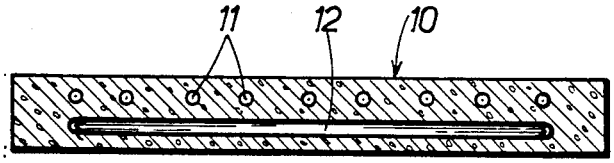
FIG. 2 is a plan view of a heat exchanger body and FIG. 3 is a view in section along the line III—III of FIG. 2.
Figure 2:
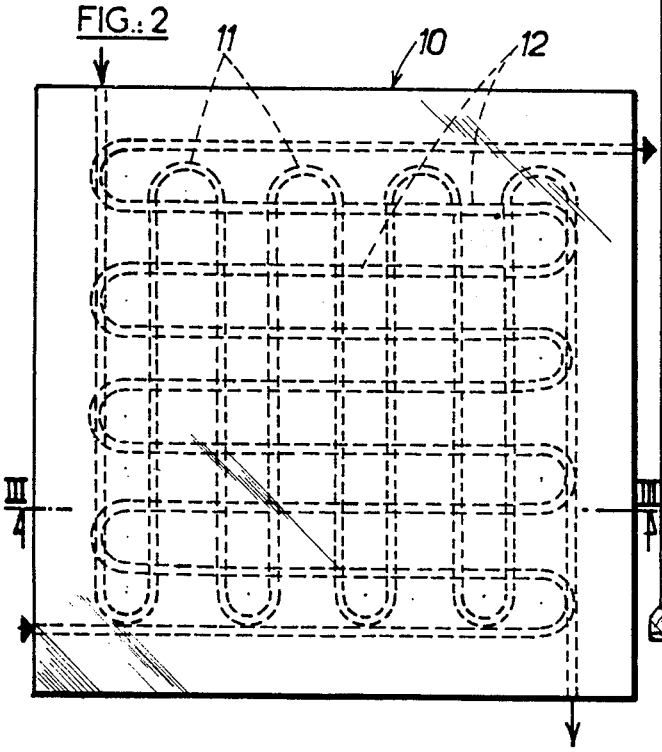

By following a process which is analogous to that of Example 1 without steel fibers, except that a wooden mold with internal dimensions of 1×1×0.09 meter is used in which two PVC winding tubes of external diameter 3 cm are positioned, the exchanger body shown in FIGS. 2 and 3 is obtained. This body 10, of relatively flat, square shape, has two channels 11 and 12 located in parallel middle planes and having intersecting directions. The ends of the channels each emerge on a different side face of the body.

EXAMPLE 3

This example describes the production, at the site of use, of a heat exchanger according to the invention for an industrial waste incinerator, the purpose of which is to recover about 1,000,00 Kcal/hour by heating air entering at about 28° C. up to about 650° C. by means of hot fumes entering at about 950° C. and leaving at about 250° C.

Figure 4:
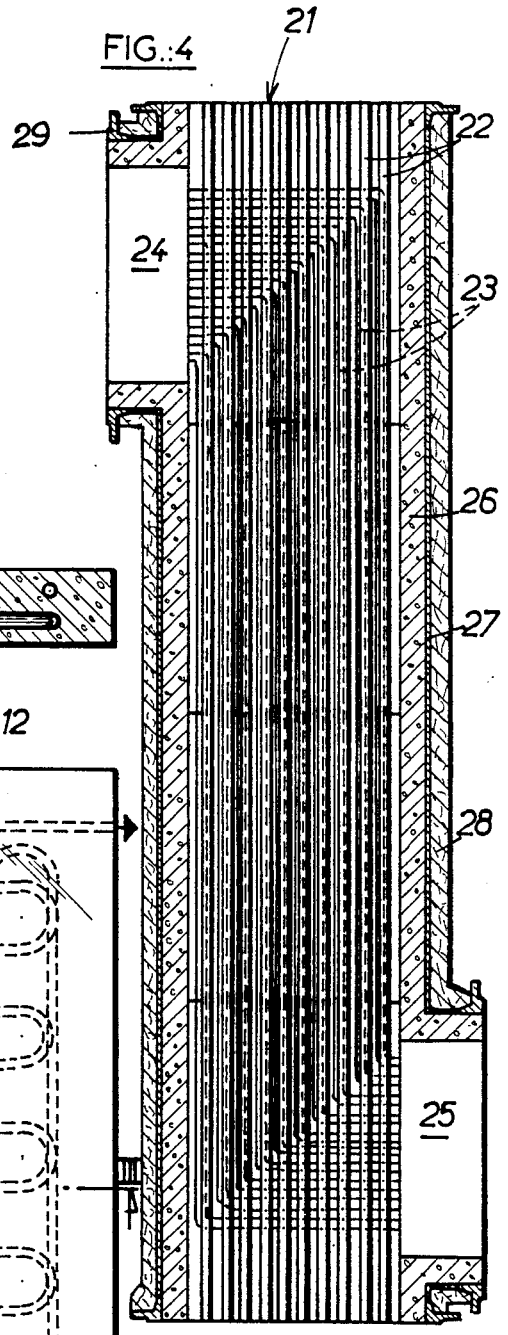
FIG. 4 is a view in axial longitudinal section of a heat exchanger according to the invention, which is intended for use with an incinerator for industrial waste.

As shown in FIG. 4, the body 21 of the exchanger comprises 360 channels 22 through which the fumes are intended to flow, and 360 channels 23 through which the air is intended to flow, all the channels having a diameter of 2.5 cm. The channels 22 are rectilinear and run from the base to the top of the body, whereas the channels 23 have 90° bends, in opposite directions, at each of their ends so as to run parallel to the channels 22 over the major part of their length, but so as to emerge on the periphery of the body at 24 and 25, as illustrated in FIG. 4. The exchange area is about 198 $m^2$.

The body, which has a diameter of 1.1 m and a height of 7 meters, is molded in the space of a few hours on site by casting about 15 tonnes of the material described in Example 1 (with fibers) in shuttering of the appropriate shape. After removal of the shuttering, a layer 26 of insulating cellular concrete with a thickness of about 100 mm is applied to the body, followed by a metal jacket 27 made of 10 mm thick steel plate and, finally, by a jacket 28 of rock wool with a thickness of 20 mm. Metal clamps, such as 29, are provided around the regions where the channels emerge, so as to facilitate connection of the fluid inlets and outlets. Obviously, it is possible to use only one insulating layer, either in the form of concrete or in the form of fibers.

The solution used to construct this apparatus consists in positioning the networks of tubes 22 and 23 in the meshes of a set of stainless steel screens with a mesh size of approximately 25 mm (screen of 1 inch mesh), fixed to a frame.

The refractory mixture is cast in sections of 850 mm in height with the aid of detachable spouts which facilitate the operation. The shuttering, consisting of two semicylindrical shells, is positioned in sections by being slid into the support frame.

Because of the size of the molding, the effect of vibrators outside the shuttering is combined with the effect of vibrators acting in the bulk of the refractory.

The heat treatment for removing the PVC tubes and for ceramization is carried out, as in Example 3, with the aid of the hot fumes available on site, or burners.

By way of illustration, the labor required to instal the shuttering on the worksite and position the tubes is of the order of 60 hours.

For gas speeds of 15 Nm/second, the coefficient of heat exchange is 45 Kcal/h.$m^2$° C.

By way of comparison, the equivalent solution using steel tubes weighs 20 tonnes, consists of an exchanger containing 121 tubes of diameter 8 cm and has an exchange area of 214 $m^2$. Its coefficient of exchange is 20 Kcal/h.$m^2$.°C. for gas speeds of 2 Nm/s. Furthermore, the pressure losses of fluid to be heated are twice as great. An exchanger of this type requires about 400 hours of welding and assembly time.

The invention is therefore universally applicable to all types of low-temperature and high-temperature exchangers and makes it possible simultaneously to solve the problems of leaktightness between the channels, heat resistance, good heat exchange, and resistance to erosion and corrosion by the various aggressive fluids or fluids charged with aggressive agents.

EXAMPLE 4

This example describes the production, at the site of use, of a heat exchanger operating at high temperature for a pusher furnace in the iron and steel industry, the purpose of which is to heat air entering at about 27° C. up to about 670° C. by means of hot fumes entering at about 800° C. and leaving at about 400° C.

A refractory material such as that of Example 1 (with steel fibers) is cast on site in shuttering of 1.3×1.3×10 m equipped with a network of 625 tubes (25×25) of external diameter 5 cm so as to give an exchange area of the order of 1000 $m^2$. 313 of these tubes are rectilinear and are intended to form the channels for fumes, whereas the other 312 tubes, which are intended to form the channels for air, have 90° bends in opposite directions at each of their ends so as to run parallel to the first 313 tubes over the major part of their length, but so as to emerge on the periphery of the body in a similar manner to that described in Example 3 with reference to FIG. 4. During casting, vibration is effected either by injecting compressed air into the tubes or by using vibrators in the manner commonly practised on concreting worksites. The molded body is released from the mold after 24 hours and left to age for 8 days. The exchanger body is then thermally insulated by means of a layer of insulating concrete or a jacket of insulating fibers, and a metal jacket is then positioned to hold the whole assembly together. The insulated body is then subjected to a heat treatment similar to that described in Example 1, using the hot fumes available from the factory and passing them through some or all of the channels in the body, as required.

What is claimed is:

1. A heat exchanger consisting essentially of a one-piece body of oxide-based refractory material, said body having a plurality of surface portions and comprising a plurality of first tubular, continuous channels for a first fluid extending therethrough and a plurality of second tubular, continuous channels for a second fluid extending therethrough, said first and second channels being distributed within the cross-section of said body in a mutual heat-exchange relationship and having middle portions which are mutually parallel, said first channels having first ends for connection to an inlet of said first fluid and second ends for connection to an outlet of said first fluid, said second channels having first ends for connection to an inlet of said second fluid and second ends for connection to an outlet of said second fluid, at least one of said first and second channels having at least one bend said bend having a radius of curvature,, and said first ends of said first channels, said second ends of said first channels, said first ends of said second channels and said second ends of said second channels opening on different surface portions of said body, said body being molded from an oxide-based refractory casting composition which sets at ambient temperature and exhibits a shrinkage lower than 0.5% upon setting.

2. The heat exchanger as claimed in claim 1, wherein the refractory material contains grains of molten and cast metal oxides of a system selected from the group consisting of $ZrO_2SiO_2$, $ZrO_2$—$SiO_2$—$Al_2O_3$ and $ZrO_2$—$SiO_2$—$Al_2O_3$—$CrO_3$.

3. The heat exchanger as claimed in claim 1, wherein the refractory material has the following composition in % by weight:

(i) 55–99% of particles of a molten and cast refractory material containing a vitreous phase based on zirconia-silica, zirconia-silica-alumina or zirconia-silica-alumina-chromium oxide, these particles having the following size distribution: 15–45% of grains with a size of 2 to 5 mm, 20–40% of small grains with a size of 0.5 to 2 mm, 15–30% of dust with a size of 40 micrometers to 0.5 mm and 0–40% of fines with a size of less than 40 micrometers;

(ii) 1 to 5% of a hydraulic cement; and (iii) 1–15% of a filler consisting of approximately spherical particles of a metal oxide with a size of 0.01 to 5 micrometers, the specific surface area of these particles being greater than 5 $m^2/g$, the proportion of each of the constituents (i), (ii) and (iii) being given relative to their total.

4. The heat exchanger as claimed in claim 3, wherein the constituent (ii) is a superaluminous cement and the constituent (iii) is vitreous silica.

5. The heat exchanger as claimed in claim 1, wherein reinforcing fibers are incorporated into the refractory material.

6. The heat exchanger as claimed in claim 5, wherein the reinforcing fibers are stainless steel fibers present in a proportion of 0.5 to 3% by weight, relative to the refractory material.

7. The heat exchanger as claimed in claim 1, which has a weight of more than 500 kilograms.

8. A heat exchanger as claimed in claim 1, which further comprises at least a layer of thermally insulating material around a major portion of said body.

9. A heat exchanger as claimed in claim 1, which further comprises metal clamps around each of said distinct surface portions of said body for facilitating connection of the fluid inlets and outlets.

10. A heat exchanger consisting of a one-piece body made of an oxide-based refractory material which sets at ambient temperature and exhibits a shrinkage of lower than 0.5% upon setting, said one-piece body having at least six surface portions and defining therein a plurality of first tubular channels for a first fluid, each of said first tubular channels having an inlet mouth at one of said at least six surface portions, an outlet mouth at a second of said at least six surface portions and a middle portion therebetween, each of said first tubular channels extending continuously from its inlet mouth to its outlet mouth, a plurality of said second tubular channels for a second fluid, each of said second tubular channels having an inlet mouth at a third of said at least six surface portions, an outlet mouth at a fourth of said at least six surface portions and a middle portion therebetween, each of said second tubular channels extending continuously from its inlet mouth to its outlet mouth, said plurality of first and second tubular channels being located within said one-piece body such that their middle portions are parallel, and at least one of said plurality of first and second tubular channels having at least one bend therein and said bend having a radius of curvature.

11. A heat exchanger as claimed in claim 10, wherein said one-piece body consists of six surface portions.

12. A heat exchanger as claimed in claim 10, wherein each of said first tubular channels is straight, wherein each of said second tubular channels has two 90° bends therein, and wherein the inlet and outlet mouths of said second tubular channels are at opposite surface portions of said one-piece body.

* * * * *